US006253800B1

(12) United States Patent
Yoshida et al.

(10) Patent No.: US 6,253,800 B1
(45) Date of Patent: Jul. 3, 2001

(54) PAINT FILLING DEVICE FOR CARTRIDGES

(75) Inventors: Osamu Yoshida, Tokyo; Hidetsugu Matsuda; Toshio Hosoda, both of Fujieda, all of (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 09/601,347

(22) PCT Filed: Dec. 9, 1999

(86) PCT No.: PCT/JP99/06918

§ 371 Date: Aug. 18, 2000

§ 102(e) Date: Aug. 18, 2000

(87) PCT Pub. No.: WO00/37180

PCT Pub. Date: Jun. 29, 2000

(30) Foreign Application Priority Data

Dec. 18, 1998 (JP) ..... 10-360960

(51) Int. Cl.[7] ..... B65B 1/04; B65B 3/04; B65B 31/00; B67C 3/00

(52) U.S. Cl. ..... 141/18; 141/21; 141/285; 141/301; 141/302; 141/309; 141/346; 141/348; 141/349; 141/383

(58) Field of Search ..... 141/18, 21, 250, 141/284, 285, 291–293, 301, 302, 309, 311 R, 346, 348, 349, 383, 386, DIG. 2

(56) References Cited

FOREIGN PATENT DOCUMENTS 8-229446 9/1996 (JP) .

*Primary Examiner*—Timothy L. Maust
(74) *Attorney, Agent, or Firm*—Oblon, Spivak, McClelland, Maier & Neustadt, P.C.

(57) ABSTRACT

A paint cartridge replenisher (51) is constituted by a replenishing stool (52) having a feed tube passage hole (56) and a container support portion (57), a connector member (59) connectable to and communicable with a fore distal end of a feed tube (28), and a replenishing valve (61) operative to turn on and off paint supply from a paint source to the connector member (59). A paint cartridge (25) is set on the container support portion (57), thereby passing the feed tube (28) into the feed tube passage hole (56) on the side of the replenishing stool and bringing a fore distal end portion of the feed tube (28) into fitting engagement with the connector member (59). In this state, the replenishing valve (61) is opened, whereupon paint is supplied from the paint source to the connector member (59) and replenished into the container (26) of the paint cartridge (25), utilizing the opening at the fore distal end of the feed tube as a replenishing port of the paint cartridge (25).

8 Claims, 11 Drawing Sheets

PAINT FILLING DEVICE FOR CARTRIDGES

TECHNICAL FIELD

This invention relates to a paint replenisher for paint cartridges which is particularly suitable, for example, for use in refilling paint cartridges of various paint colors which are designed to be replaceably mounted on a coating apparatus.

BACKGROUND ART

Generally, rotary atomizing head type coating apparatus are widely resorted to in coating work pieces such as vehicle bodies or the like. In this regard, lately there are increasing demands for coating apparatus which can cut the amounts of paint and solvent to be discarded each time when changing the paint color and which can cope with a larger number of paint colors.

For instance, regarding rotary atomizing head type coating apparatus which are arranged to reduce the amounts of discarding paint and solvent and at the same time to cope with an increased number of paint colors, there has been known a coating apparatus as disclosed in Japanese Laid-Open Patent Publication No. H8-229446. This rotary atomizing head type coating apparatus employs a number of paint cartridges of different colors which are arranged to be replaceably loaded on the coating apparatus in the course of a coating operation on a vehicle body or bodies.

More specifically, the rotary atomizing head type coating apparatus just mentioned is largely constituted by a housing which is so shaped as to provide a coating machine mount portion on the front side and a cartridge mount portion on the rear side thereof, and a coating machine which is mounted on the coating machine mount portion of the housing, including an air motor with a rotational shaft and a rotary atomizing head which is mounted on the rotational shaft on the front side of the air motor. A feed tube passage hole is passed axially within the rotational shaft of the air motor of the coating machine, and said feed tube passage hole is into the rotary atomizing head at its fore end and opened into the cartridge mount portion of the housing at its rear end.

The coating apparatus is provided with a number of paint cartridges of different colors which are designed to be replaceably mounted on the cartridge mount portion of the housing. Each one of these paint cartridges is constituted by a container which is filled with paint, and a feed tube which is extended axially forward from a fore end of the paint container. The paint container is adapted to be replaceably set in position on the cartridge mount portion of the housing, with the feed tube passed into the above-mentioned feed tube passage hole.

Further, provided internally of each paint cartridge is a movable partition wall which divides the internal space of the cartridge into a paint chamber and an extruding air chamber, and an air passage which is provided on the part of the cartridge to supply extruding air to the extruding air chamber. Provided also on the part of the housing is an extruding air passage which is communicated with the extruding air passage on the side of the paint cartridge. Thus, through the extruding air passage on the side of the housing and the extruding air passage on the side of the paint cartridge, extruding air is supplied to the extruding air chamber to push the movable partition wall forward, thereby extruding the paint in the paint chamber into the rotary atomizing head through the feed tube.

In the case of the rotary atomizing head type coating apparatus which is arranged as described above, a paint cartridge of a desired color is selected from a group of paint cartridges of different colors, and set on the paint cartridge mount portion on the housing. Then, air is supplied to the extruding air chamber in paint cartridge to let the paint in the paint chamber of the cartridge spurt out toward the rotary atomizing head through the feed tube. As a result, paint is sprayed toward an object to be coated from the rotary atomizing head.

The paint color can be changed simply by replacing the paint cartridge by a cartridge of a desired color without discarding paint and solvent.

On the other hand, at the end of a coating operation, since a paint within a paint cartridge which has been dismantled for a change of paint color is more or less consumed and a paint need to be refilled in preparation for a next use.

In refilling used paint cartridges, it has been the general practice to use a paint refilling system. For example, a paint cartridge refilling system which is used in the above-mentioned prior art is provided with quick joints which are extended out from tap pipes of paint circulation system of different colors. Firstly, a used paint cartridge is dismantled from the housing and put on a refilling table for replenishing paint into a paint chamber of the cartridge. Then, the quick joint is connected to a paint supply port, which is provided on the cartridge separately from the feed tube, exclusively for refilling purposes.

Therefore, with the rotary atomizing head type coating apparatus which is described above, a paint supply post is provided on the cartridge separate from the feed tube and a paint is refilled into the cartridge from a paint supply post. Thereby, the construction of the paint cartridge becomes complicated and increases the production cost. In addition, it has a possibility to increase the position of paint leaks.

Namely, the prior art paint cartridge refilling system is arranged to replenish a paint cartridge by connecting a paint supply port of the cartridge to one of quick joints from a paint circulation piping system. The refilling system of this sort has problems or drawbacks in that it requires a lot of efforts in connecting a paint supply port to a quick joint and consumes a great deal of time for the connecting work.

DISCLOSURE OF THE INVENTION

In view of the problems with the above-mentioned prior art, it is an object of the present invention to provide a paint replenisher for paint cartridges, which is so arranged as to make it possible to simplify the construction of paint cartridges and to facilitate paint refilling operations.

In order to achieve the above-stated objective, according to the present invention, there is provided a paint replenisher for a paint cartridge having a feed tube extended axially forward from one end of a paint container, characterized in that the paint replenisher comprises: a replenishing stool having a feed tube passage hole formed axially therethrough to receive the feed tube of the paint cartridge, and provided with a container support portion adapted to support the container of the paint cartridge over an upper open end of the feed tube passage hole; a connector member provided within the replenishing stool in a deeper position than the feed tube passage hole and adapted to connect a fore distal end portion of the feed tube to a paint passage leading to a paint source; and a replenishing valve provided in the paint passage and adapted to turn on and off paint supply to the paint cartridge through the connector member.

With the arrangements just described, upon completing one coating operation, a used paint cartridge is removed from a housing of a coating apparatus, and set on a container support portion which is formed on a replenishing stool of the paint replenisher. At this time, the feed tube of the paint cartridge is passed into the feed tube passage hole, fitting a fore distal end portion of the feed tube into the connector member in the replenishing stool. In this state, the replenishing valve is opened to supply paint from a paint source to the connector member, permitting the paint to be replenished into the container of the paint cartridge through the fore distal end of the feed tube which is in fitting engagement with the connector member. As soon as a specified amount of paint is replenished into the container, the replenishing valve is closed to stop the paint supply, namely, to complete the replenishment of the paint cartridge.

In this instance, preferably the connector member is axially movably provided within the replenishing stool, and associated with a biasing spring member and thereby constantly urged in a direction toward the feed tube of the paint cartridge.

With the arrangements just described, upon setting a paint cartridge on the replenishing stool, a fore distal end portion of the feed tube is brought into fitting engagement with the connector member. At this time, the connector member can be moved in the axial direction depending upon the position of the fore distal end of the feed tube. In addition, the connector member is pushed against the feed tube by the action of the spring member and thereby tightly and securely fitted on the distal end portion of the feed tube.

In a preferred form of the present invention, the replenishing valve is constituted by an influent paint passage connected to the paint source, an effluent paint passage for returning paint to the paint source, a paint supply passage for connecting the influent paint passage to the connector member, and a directional control valve operative to connect the influent paint passage either to the effluent paint passage or to the pain supply passage.

With the arrangements just described, in a standby stage prior to paint replenishment, the influent paint passage is switched into communication with the effluent paint passage by the paint passage directional control valve. Therefore, paint from a paint source is circulated through a circuit including the influent and effluent paint passages to prevent separation and/or sedimentation of pigment components of the paint while in the standby state. On the other hand, at the time replenishing paint into the cartridge, the effluent paint passage is switched to communicate with the paint supply passage by the paint passage directional control valve. Consequently, paint from a paint source is supplied to the container through the influent paint passage, paint supply passage, connector member and feed tube.

On the other hand, the replenishing valve to be used in the present invention is preferably provided with a drain passage which connects the paint supply passage to a drain side, and a residual pressure extraction valve which is provided within a length of the drain passage.

With the arrangements just described, when the residual pressure extraction valve is opened, residual pressure in the feed tube and the container can be extracted through the connector member to restore an atmospheric pressure level therein.

In this instance, preferably the connector member is provided with a feed tube positioning portion which is adapted to hold a fore distal end portion of the feed tube in a predetermined position by engagement therewith.

With the arrangements just described, upon bringing a fore distal end portion of the feed tube into fitting engagement with the connector member, the fore distal end of the feed tube can be automatically located in a predetermined position relative to the connector member by the feed tube position portion.

Further, preferably the container support portion of the replenishing stool is provided with a container positioning portion which is adapted to hold the container in position on the container supporting portion by engagement with a front end portion of the container.

With the arrangements just described, upon setting a paint cartridge on the container support portion of the replenishing stool, a front side of the container is engaged with the container positioning portion and thereby automatically located in a predetermined position on the container support portion of the replenishing stool.

On the other hand, according to the present invention, preferably the replenishing stool further comprises a vacuum space which is formed in the container support portion on the inner side of the said container when the cartridge is set in position on the container support portion, and an air suction passage opened into the vacuum space and operative to suck out air from the vacuum space to grip the container fixedly in the container support portion by suction force.

With the arrangements just described, after fitting the container in the container support portion on the replenishing stool, air is sucked out from the vacuum space on the inner side of the container through the air suction passage to grip the container fixedly in the container support portion by suction force. When dismantling the paint cartridge, air is supplied to the vacuum space to cancel the suction grip on the paint cartridge.

Further, according to the present invention, preferably the replenishing stool further comprises a pilot air passage which is adapted to supply pilot air to a paint valve provided on the side of the paint cartridge.

With the arrangements just described, pilot air is supplied through the pilot air passage at the time of paint replenishment, thereby opening the paint valve in the paint cartridge and permitting to replenish paint thereto through the paint passage in the feed tube. The supply of pilot air is stopped as soon as a paint replenishing operation is completed. As a result, the paint valve is closed to prevent paint leaks from the feed tube.

Further, according to the present invention, preferably the replenishing stool further comprises an extruding liquid discharging passage for a paint extruding liquid which is discharged from the container during a paint replenishing operation on the paint cartridge.

With the arrangements just described, while a container is replenished with paint, a paint extruding liquid is discharged through the extruding liquid discharging passage in proportion to the amount of refilled paint.

BEST MODE FOR CARRYING OUT THE INVENTION

Figure 1:
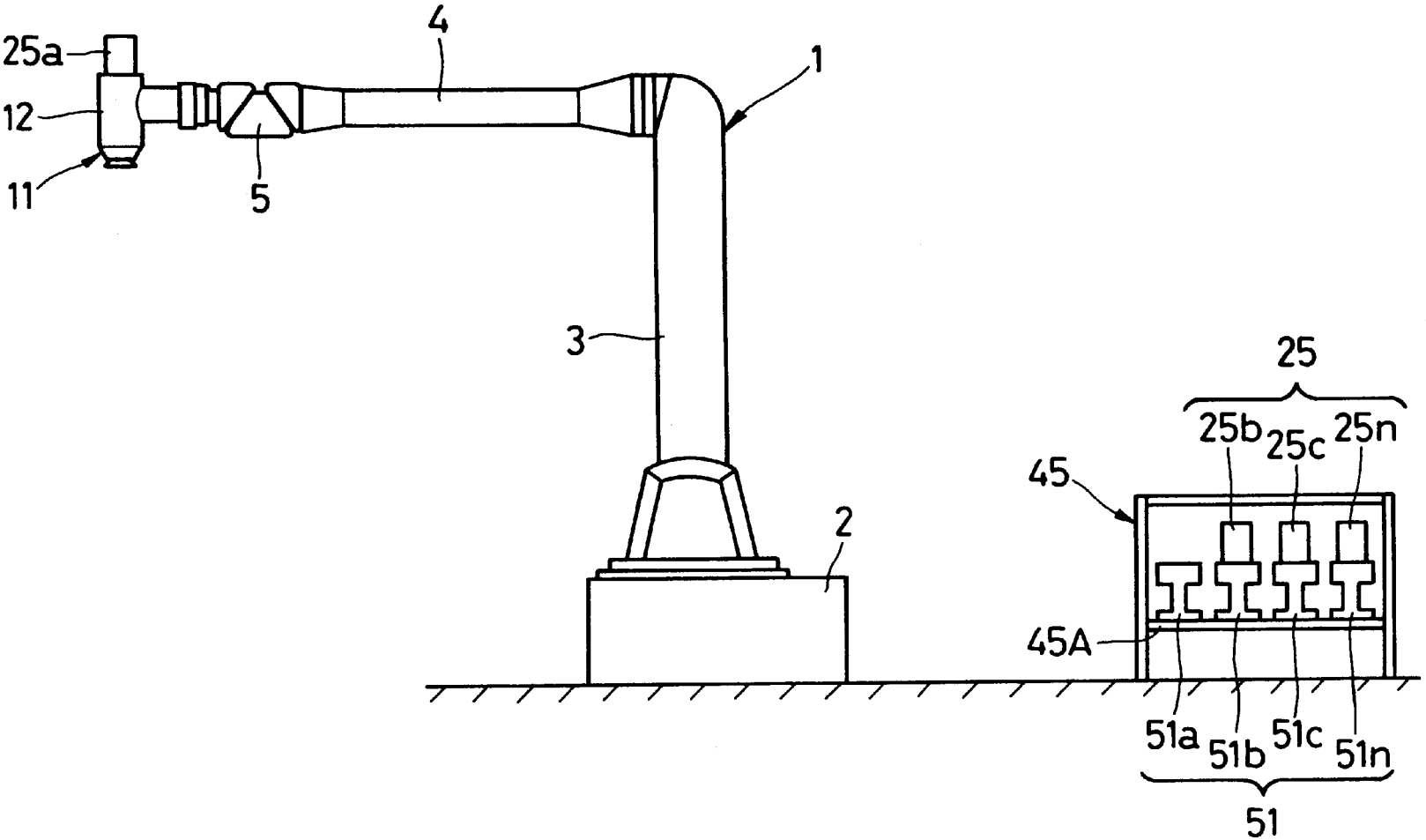
FIG. 1 is a front view of a paint replenisher embodying the present invention, the paint replenisher being shown along with a rotary atomizing head type coating apparatus and a coating robot.

Hereafter, the paint replenisher according to the present invention is described more particularly by way of its preferred embodiment with reference to FIGS. 1 through 12 of the accompanying drawings, for example, in connection with a refilling operation for paint cartridges which are designed to be replaceably and interchangeably mounted on a rotary atomizing head type coating apparatus.

In the drawings, indicated at 1 is a coating robot which is employed as a working mechanism. The coating robot 1 is largely constituted by a base or pedestal 2, a vertical arm 3 which is rotatably and pivotally supported on the base 2, a horizontal arm 4 which is pivotally connected to the top end of the vertical arm 3, and a wrist portion 5 which is provided at the fore distal end of the horizontal arm 4.

Figure 2:
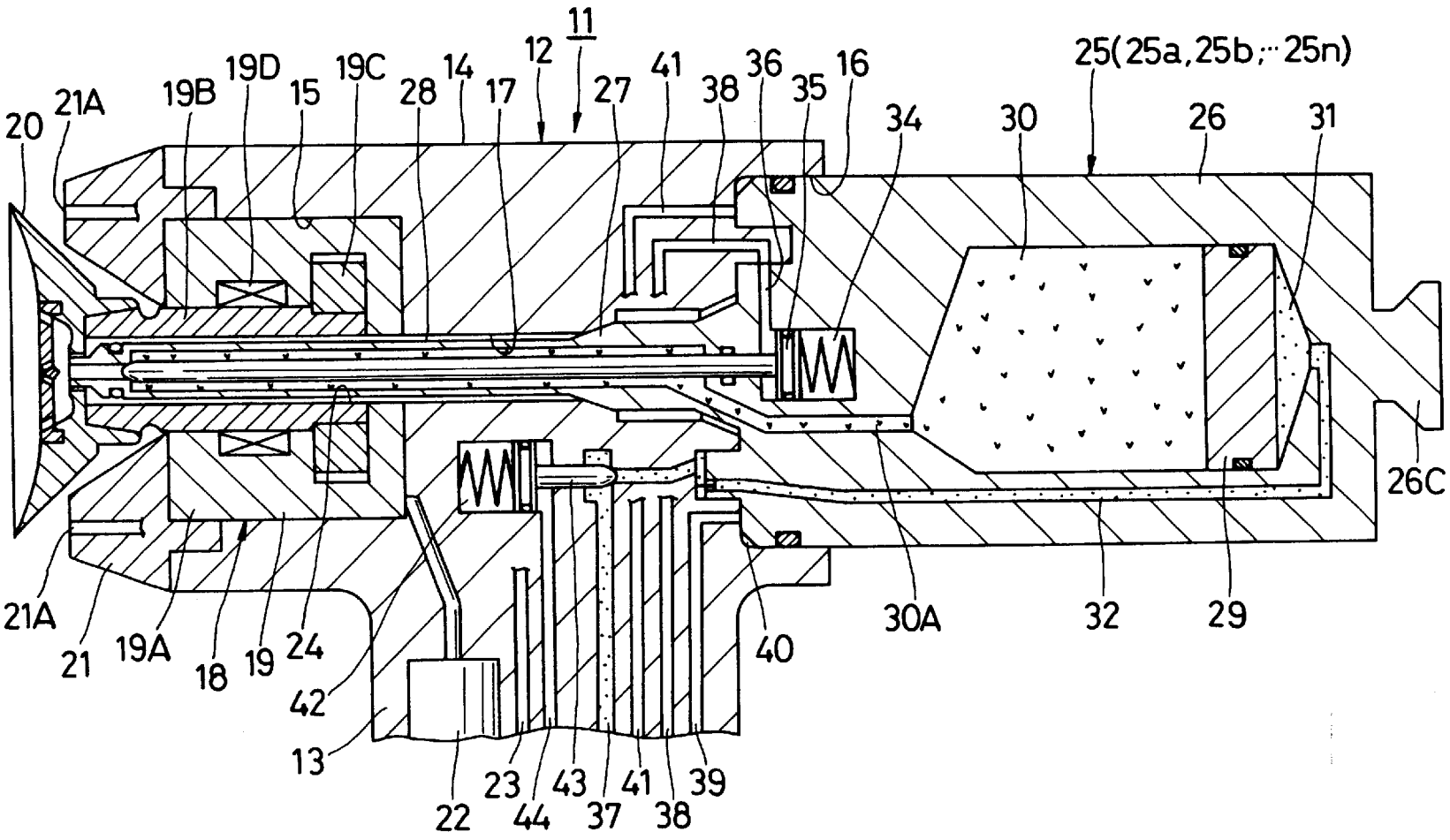
FIG. 2 is an enlarged vertical sectional view of the rotary atomizing head type coating apparatus shown in FIG. 1.

Denoted at 11 is a rotary atomizing head type coating apparatus (hereinafter referred to as "coating apparatus 11" for brevity) which is provided on the coating robot 1. As shown in FIG. 2, the coating apparatus 11 is largely constituted by a housing 12, feed tube passage holes 17 and 24, coating machine 18, paint cartridge 25, paint valve 35, thinner valve 43 as will be described in greater detail hereinafter.

The housing 12 is formed of engineering plastic material, for example, such as PTFE, PEEK, PEI, POM, PI, PET and the like, and attached to a fore distal end of the wrist 5. The housing 12 is constituted by a neck portion 13 which is detachably supported at the distal end of the wrist 5, and a head portion 14 which is integrally formed at the distal end of the neck portion 13.

Figure 4:
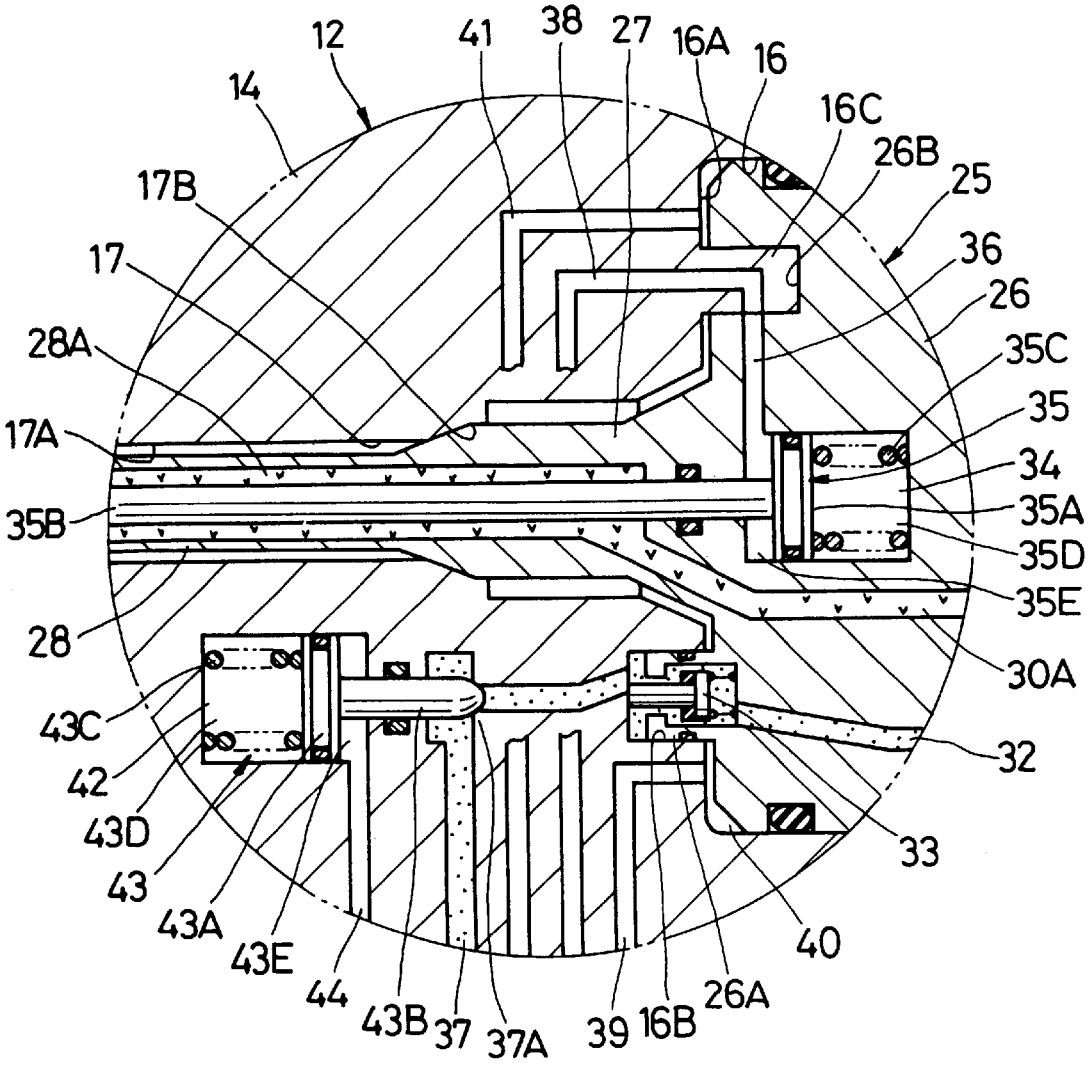
FIG. 4 is an enlarged vertical sectional view of paint valve, thinner valve, quick coupling shown in FIG. 2.

In this instance, a coating machine mount portion 15 is formed with a cylindrical cavity on the front side of the head portion 14. A cartridge mount portion 16 is formed with a cylindrical cavity on the rear side of the head portion 14. As shown in FIG. 4, a female connector portion 16B and a male connector portion 16C are separately formed separately at the bottom 16A of the cartridge mount portion 16 for fitting engagement with a male connector portion 26A and a female connector portion 26B of a container 26, respectively, as will be described hereinafter. These female and male connector portions 16B and 16C on the part of the cartridge mount portion 16 to bring the container 26 to a predetermined position in the circumferential direction when setting the latter on the cartridge mount portion 16.

Indicated at 17 is a feed tube passage hole which is provided on the part of the housing 12, between and in communication with the coating machine mount portion 15 and the cartridge mount portion 16 on the head portion 14. This feed tube passage hole 17 on the side of the housing is comprised of a front portion in the form of a feed tube passage portion 17A of a small diameter, and a rear portion in the form of a conical cavity 17B converging toward the feed tube passage portion 17A. In this instance, the feed tube passage portion 17A is formed coaxially with a feed tube passage hole 24 which is provided on the part of the coating machine as will be described hereinafter. The converging conical cavity 17B is so arranged as to be brought into fitting engagement with a conical projection 27 which is provided on the side of the paint cartridge 25 as will be described after, for the purpose of setting the paint cartridge in a predetermined position in axial and radial directions.

Denoted at 18 is a coating machine which is mounted within the coating machine mount portion 15 on the head portion 14. As seen in FIG. 2, the coating machine 18 is largely constituted by an air motor 19 including a motor case 19A, a rotational shaft 19B, an air turbine 19C and an air bearing 19D, a rotary atomizing head 20 adapted to be rotated by the air motor 19 for centrifugally atomizing supplied paint into fine particles and spraying same toward a work piece, and a shaping air ring 21 which is located on the front side of the air motor 19. The shaping air ring 21 is provided with a large number of shaping air outlet holes 21A on its outer peripheral side for spurting shaping air in a forward direction. More specifically, the shaping air outlet holes 21A are so formed as to spurt shaping air toward paint releasing edges of the rotary atomizing head 20 for shaping paint particles into a predetermined spray pattern as soon as they are released from the rotary atomizing head 20.

Indicated at 22 is a high voltage generator which is provided on the neck portion 13 of the housing 12. For instance, the high voltage generator 22 is constituted by a Cockroft circuit and adapted to elevate a source voltage from a power supply (not shown) to a high voltage in the range of from −60 kv to −120 kv. The output side of the high voltage generator 22 is electrically connected, for example, to the air motor 19, so that a high voltage is applied to the rotary atomizing head 20 through the rotational shaft 19B of the air motor 19 to charge the paint directly.

Designated at 23 are a plural number of air passages which are provided in the neck portion 13 of the housing 12 and connected to an air source (not shown). These air passages 23 convey turbine air, bearing air and brake air for controlling the air motor 19, as well as shaping air for shaping the spray pattern. In the particular embodiment shown, these air passages are represented by one air passage.

Indicated at 24 is a feed tube passage hole on the side of the coating machine, the feed tube passage hole 24 being formed axially through the rotational shaft 19B of the air motor 19. A base or rear end of the feed tube passage hole 24 on the side of the coating machine is opened into the feed tube passage portion 17A of the feed tube passage hole 17 on the side of the housing, while a fore end of the feed tube passage hole 24 is opened into the rotary atomizing head 20. Further, the feed tube passage hole 24 on the side of the coating machine is formed in coaxial relation with the feed tube passage portion 17A of the feed tube passage hole 17 on the part of the housing. Extractably placed in these feed tube passage holes 17 and 24 is a feed tube 28 of the paint cartridge 25.

Figure 3:
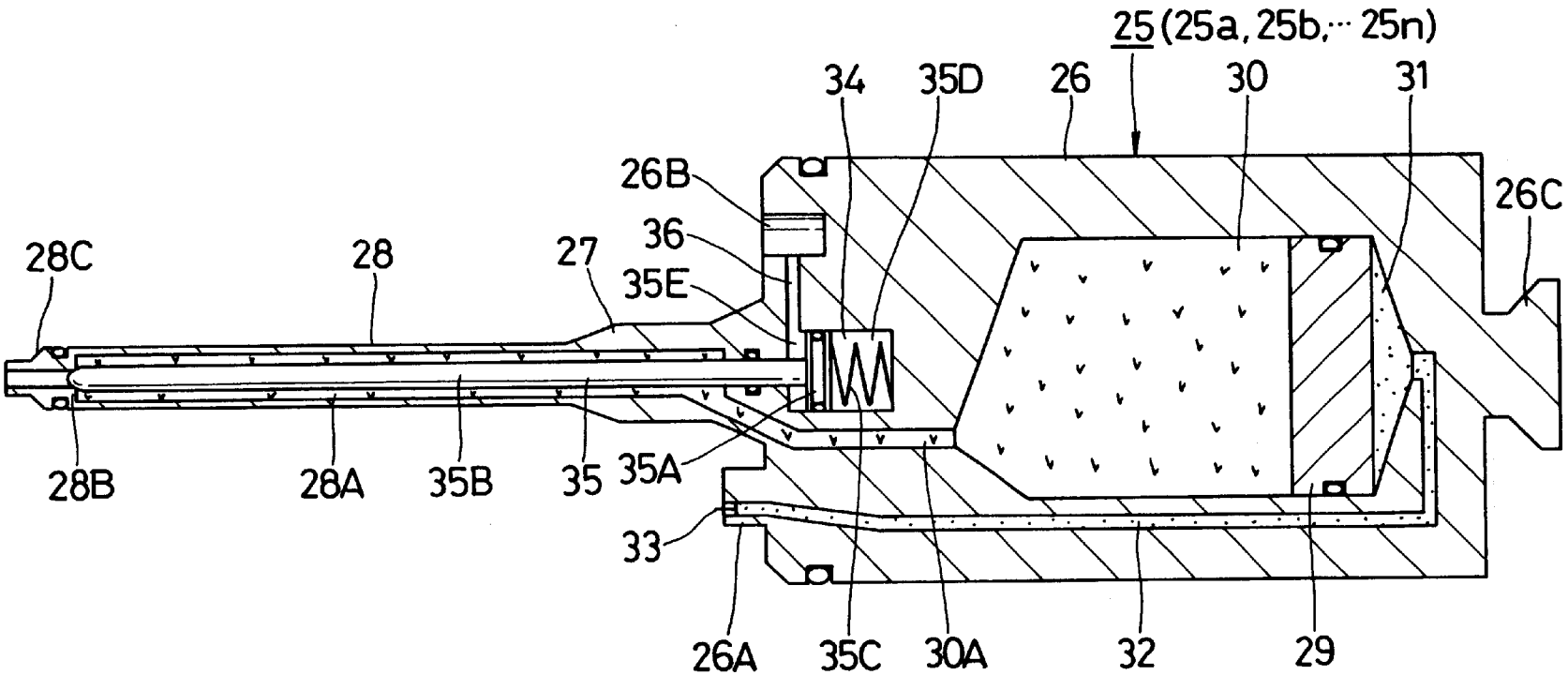
FIG. 3 is a vertical sectional view of a paint cartridge.

Indicated at 25*a*, 25*b*, . . . 25*n* are paint cartridges of color a, color b, . . . color n (hereinafter referred to collectively as "cartridges 25" for brevity) which contain paint of different colors to be supplied to the rotary atomizing head 20. In this instance, as shown in FIG. 3, the paint cartridges 25 are each constituted largely by a container 26, a conical projection 27 which is provided on a front end face of the container 26, a feed tube 28 which is extended axially forward from the conical projection 27, a piston 29 which is fitted in the container 26 to serve as a movable partition wall, and a thinner passage 32 which is provided on the part of the cartridge to supply thinner therethrough as an extruding liquid.

The container 26, which forms a main body of the paint cartridge 25, is formed of engineering plastics similarly to the housing 12, and is formed in the shape of a tube (a cylinder) of a diameter which can be detachably fitted in the cartridge mount portion 16 of the housing 12. The container 26 is provided with male and female connector portions 26A and 26B on its front end face in confronting positions relative to the female and male connector portions 16B and 16C on the cartridge mount portion 16, respectively. Further, on a rear end face, the container 26 is provided with a grip portion or a grip-like projection 26C to be gripped at the time of replacement of the paint cartridge 25.

In this instance, the male and female connector portions 26A and 26B serve to guide the container 26 to a predetermined position in the circumferential direction when mounting the container 26 on the cartridge mount portion 16 of the coating apparatus 11. The male and female connector portions 26A and 26B also serve to guide the container 26 to a predetermined position in the circumferential direction when setting the container 26 on a container support portion 57 of a paint replenisher 51 which will be described hereinafter.

Indicated at 27 is a conical projection which is formed integrally on the front side of the container 26. When the container 26 of the paint cartridge 25 is set in the cartridge mount portion 16 of the coating apparatus 11, the conical projection 27 is brought into fitting engagement with the converging conical portion 17B to set the container 26 in position both in axial and radial directions. Further, when the paint cartridge 25 is set on a container support portion 57 of a paint replenisher 51, the conical projection 27 is similarly brought into fitting engagement with a converging conical portion 56A on the side of the container support portion 57 to set the container 26 of the paint cartridge 25 automatically in position in both axial and radial directions.

The feed tube 28 which is provided at the fore distal end of the conical projection 27 is internally provided with a coaxially extending paint supply passage 28A. At a base or rear end, the paint supply passage 28A is connected to a paint reservoir chamber 30 which will be described after. On the other hand, at a fore end, the paint supply passage 28A is opened toward the rotary atomizing head 20. Further, a valve seat 28B is formed integrally on the inner periphery of a fore end portion of the feed tube 28 by partly reducing the diameter of the paint supply passage 28A, for seating on and off a valve member 35B of a paint valve 35 which will described after. Further, in a fore end portion, the outer periphery of the feed tube 28 is gradually reduced in diameter in the forward direction to provide a conically projecting portion 28C. This conically projecting portion 28C is brought into fitting engagement with a conical recess 59C of a movable connector member 59, which will be described hereinafter, for positioning a fore tip end of the feed tube 28 at the center of the just-mentioned movable connector member 59. The feed tube 28 is arranged in such a length that its fore tip end is extended into the rotary atomizing head 20 when the paint cartridge 25 is set in position within the cartridge mount portion 16 of the housing 12.

In this instance, by way of the paint supply passage 28A, the feed tube 28 conveys the paint which is supplied from the paint reservoir chamber 30, and spouts the paint from its fore end toward the rotary atomizing head 20. In addition, at the time of refilling paint into the paint reservoir chamber 30 of the paint cartridge 25, the fore end of the feed tube 28 is connected to the movable connector member 59 and used as a refilling or replenishment port.

On the other hand, by the piston 29 which is axially slidably fitted in the container 26, the internal space of the container 26 is divided into a paint reservoir chamber 30 which is in communication with the paint supply passage 28A of the feed tube 28 through an intercommunicating passage 30A, and a thinner chamber 31 which holds thinner therein as an extruding liquid.

Indicated at 32 is a thinner passage on the side of the paint cartridge. The thinner passage 32 is extended axially along and on the side of the outer periphery of the container 26, one end of the thinner passage being opened toward the fore end face of the male connector portion 26A of the container 26 while the other end is communicated with the thinner chamber 31. This thinner passage 32 on the side of the paint cartridge supplies thinner to the thinner chamber 31 to push the piston 29 toward the feed tube 28, whereupon the paint in the paint reservoir chamber 30 is pushed out toward the rotary atomizing head 20.

The thinner which is used as an extruding liquid should be of an electrically insulating type or of high electrical resistance in order to prevent leaks of high voltage from the high voltage generator 22. In case thinner is used as an extruding liquid, the thinner contributes to wet the inner wall surfaces of the container 26 as the piston 29 is moved therealong, thereby preventing the paint from drying up and solidifying on the inner wall surfaces of the container 26. As a consequence, the frictional resistance between the piston 29 and the container 26 is stabilized to ensure smooth movement of the piston 29 within the container 26. Besides, it contributes to improve a tighter seal between the piston 29 and inner wall surfaces of the container 26.

Indicated at 33 is a quick coupling which is provided within the male connector portion 26A of the container 26 at an open end of the thinner passage 32 on the side of the cartridge. The quick coupling 33 is arranged as a check valve including the male connector portion 26A of the container 26. More particularly, as shown in FIG. 5, the quick coupling 33 is largely constituted by the male connector portion 26A, a valve member 33A of a stepped cylindrical shape, a coil spring 33B adapted to bias the valve member 33A in a protruding direction, and a resilient ring 33C of rubber or the like fitted on the outer periphery of the valve member 33A to form a seal between the valve member 33A and the male connector portion 26A.

When the paint cartridge 25 is set in position within the cartridge mount portion 16, with the female connector portion 16B in fitting engagement with the male connector portion 26A as shown in FIG. 3, the quick coupling 33 is opened as the fore distal end of the valve member 33A comes into abutting engagement against a bottom portion of the female connector portion 16B. As a result, the quick coupling 33 intercommunicates the thinner passage 32 on the side of the paint cartridge and the thinner passage 37 on the side of the housing, which will be described hereinafter.

Figure 5:
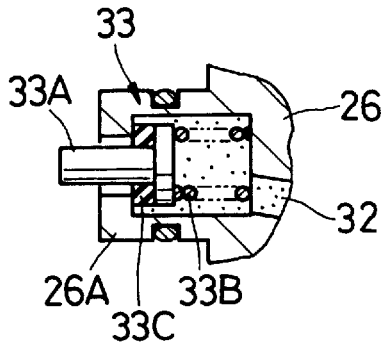
FIG. 5 is a vertical sectional view of the quick coupling shown in FIG. 4, showing the quick coupling in a closed state on a further enlarged scale.
Figure 6:
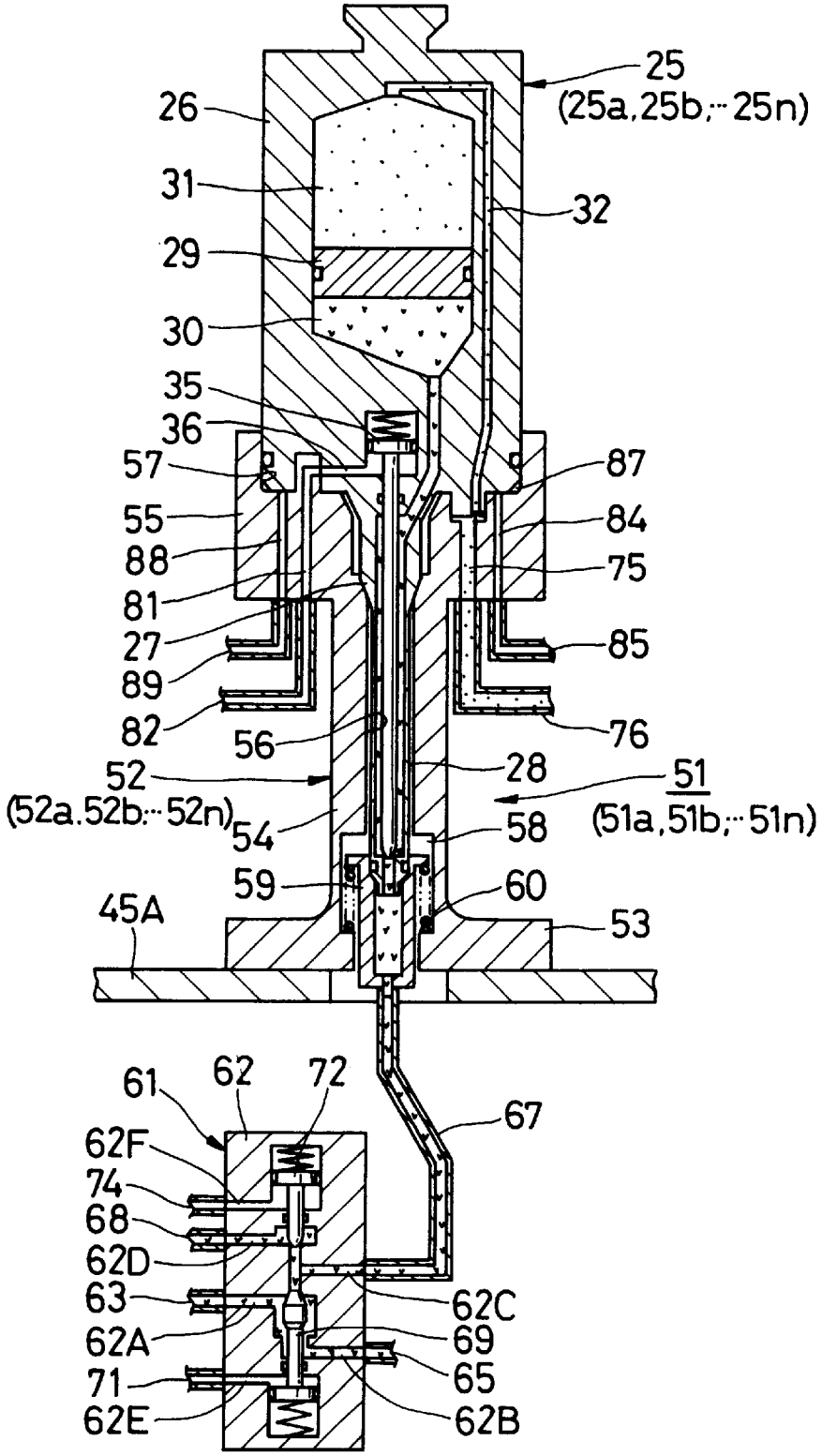
FIG. 6 is a vertical sectional view of the paint replenisher and a paint cartridge according to the present invention.

On the other hand, when the container 26 is removed from the cartridge mount portion 16, disengaging the male connector portion 26A from the female connector portion 16B as shown in FIG. 5, the valve member 33A of the quick coupling 33 is pushed against the male connector portion 26A along with the resilient ring 33C by the action of the coil spring 33B, closing the thinner passage 32 on the side of the paint cartridge to prevent an outflow of the thinner therefrom. The quick coupling 33 is opened and closed in the same manner when the paint cartridge 25 is mounted on and dismantled from a container support portion 57 of a replenishing stool 52 which will be described hereinafter.

Denoted at 34 is a hollow paint valve receptacle portion, and at 35 a paint valve which is provided within the receptacle portion 34. In this instance, the paint valve 35 is constituted by a piston member 35A which is slidably received in the receptacle portion 34, an elongated valve member 35B which has a fore end portion thereof extended into the feed tube 28 for seating on and off the valve seat 28B, and a valve spring 35C which is adapted to bias the valve member 35B toward the valve seat 28B through the piston member 35A. By the piston member 35A, the paint valve receptacle portion 34 is divided into a spring chamber 35D for the valve spring 35C and a pressure receiving chamber 35E which receives a pilot pressure. Thus, the paint valve 35 is arranged as an air-piloted directional control valve.

Normally, the valve member 35B of the paint valve 35 is seated on the valve seat 28B of the feed tube 28 under the influence of the biasing action of the valve spring 35C, thereby closing the paint supply passage 28 to suspend paint supply to the rotary atomizing head 20. On the other hand, as soon as pilot air is supplied to the pressure receiving chamber 35E from paint valve pilot air source and pilot air piping (both not shown) and a pilot air passage 38 on the side of the housing and a pilot air passage 36 on the side of the paint cartridge, the valve member 35B is unseated against the action of the valve spring 35C to permit paint supply from the paint reservoir chamber 30 to the rotary atomizing head 20. In this instance, one end of the pilot air passage 36 is opened toward the inner periphery of the female connector portion 26B of the container 26, and the other end is communicated with the pressure receiving chamber 35E of the spring valve.

Indicated at 37 is a thinner passage on the side of the housing 12, namely, a thinner passage which is provided within the housing 12. This thinner passage 37 is extended axially within the neck portion 13 and bent backward in L-shape at a position alongside the female connector portion 16B. This thinner passage 37 on the side of the housing has its one end connected to a thinner supply or feed device (not shown), and has the other end opened in a bottom portion of the female connector portion 16B of the cartridge mount portion 16. Further, the bent portion of the thinner passage 37 on the side of the housing is arranged to provide a valve seat 37A for seating on and off a valve member 43B of a thinner valve 43 which will be described hereinafter.

Indicated at 38 is a pilot air passage which is provided on the side of the housing 12. One end of this pilot air passage 38 is connected to a paint valve pilot air source through a pilot air pipe (both not shown). The other end of the pilot air passage 38 is opened in a peripheral surface portion of the male connector portion 16C which is provided on the bottom portion 16A of the cartridge mount portion 16 in confronting relation with the pilot air passage 36 on the side of the paint cartridge.

Denoted at 39 is an air suction passage which is provided on the part of the housing 12 and opened at the bottom 16A of the cartridge mount portion 16. This air suction passage 39 is connected to a vacuum source through a vacuum pipe (both not shown). Through the air suction passage 39, air is sucked out from a vacuum space 40 (FIG. 4) which is formed at the depth of the cartridge mount portion 16 on the inner side of the container 26 to fix the paint cartridge 25 in the cartridge mount portion 16 with suction force.

Indicated at 41 is an ejecting air passage which is provided in the housing 12 and opened at the bottom 16A of the cartridge mount portion 16. This ejecting air passage 41 is connected to an ejecting air source through an air pipe (both not shown). Through the ejecting air passage 41, air is supplied to the vacuum space 40 to release the paint cartridge 25 from the grip of suction force at the time of dismantling the cartridge 25.

Indicated at 42 is a hollow thinner valve receptacle portion which is provided in the head portion 14 of the housing 12, and at 43 a thinner valve which is provided in the thinner valve receptacle portion 42. In this instance, substantially in the same manner as the paint valve 35, the thinner valve 43 is constituted by a piston member 43A which is slidably received in the hollow thinner valve receptacle portion 42, a valve member 43B having its base end fixedly connected to the piston member 43A and having its fore end extended through the thinner passage 37 on the side of the housing for seating on and off the valve seat portion 37A, and a valve spring 43C adapted to bias the valve member 43B toward the valve seat 37A through the piston member 43A. By the piston member 43A, the internal space of the hollow thinner valve receptacle portion 42 is divided into a spring chamber 43D for accommodating the valve spring 43C, and a pressure receiving chamber 43E which receives a pilot pressure. Thus, similarly the thinner valve 43 is arranged as an air piloted directional control valve.

Under the influence of the biasing action of the valve spring 43C, the valve member 43B of the thinner valve 43 is normally seated on the valve seat 37A in the thinner passage 37 on the side of the housing, thereby closing the thinner passage 37 to suspend thinner supply to the thinner chamber 31. On the other hand, as soon as pilot air is supplied to the pressure receiving chamber 43E from a thinner valve pilot air source through a pilot air pipe (both not shown) and via the pilot air passage 44, the valve member 43B is unseated from the valve seat 37A against the action of the biasing spring 43C to permit thinner supply to the thinner chamber 31. In this instance, one end of the pilot air passage 44 is connected to the thinner valve pilot air source through a pilot air pipe, while the other end is communicated with the pressure receiving chamber 43E of the thinner valve 43.

Indicated at 45 is a cartridge changer which is provided, for example, within a coating booth and at a position in the vicinity of the coating robot 1 (see FIG. 1). In this instance, the cartridge changer 45 is largely constituted by a paint replenisher 51 which plays the role of replenishing containers 30 of paint cartridges 25 which have been consumed as a result of a coating operation, and a paint cartridge loading/unloading system which operates between the paint replenisher 51 and the cartridge mount portion 16 of the housing 12 to load and unload the paint cartridges 25. Provided in the vicinity of a loading/unloading position of the cartridge loading/unloading system is an atomizing head washer (not shown) which washes deposited previous color off the rotary atomizing head 20.

With reference to FIGS. 6 through 12, description is now directed to the paint replenisher which forms part of the cartridge changer.

Indicated at 51*a*, 51*b*, . . . 51*n* are paint replenisher units for paint colors a, b, . . . n (hereinafter referred to collectively as "paint replenishers 51" for brevity) which are provided on the cartridge changer 51. Each one of the paint replenishers 51 is largely constituted, as will be described in greater detail hereinafter, by a replenishing stool 52, a feed tube passage hole 56 on the part of the replenishing stool, a movable connecting member 59, and a replenishing valve 61.

Designated at 52*a*, 52*b* . . . 52*n* are replenishing stools which constitute the respective paint replenisher units 51 of different colors (hereinafter referred to collectively as "replenishing stools" 52). Each one of the replenishing stools 52 is largely constituted by a foot portion 53 which is fixed to a crossbar 45A of the cartridge changer 45 by the use of bolts or other fixation means, a column portion 54 which is extended vertically upward from the foot portion 53, and a seating block portion 55 which is formed by bulging an upper end portion of the column portion 53.

Figure 7:
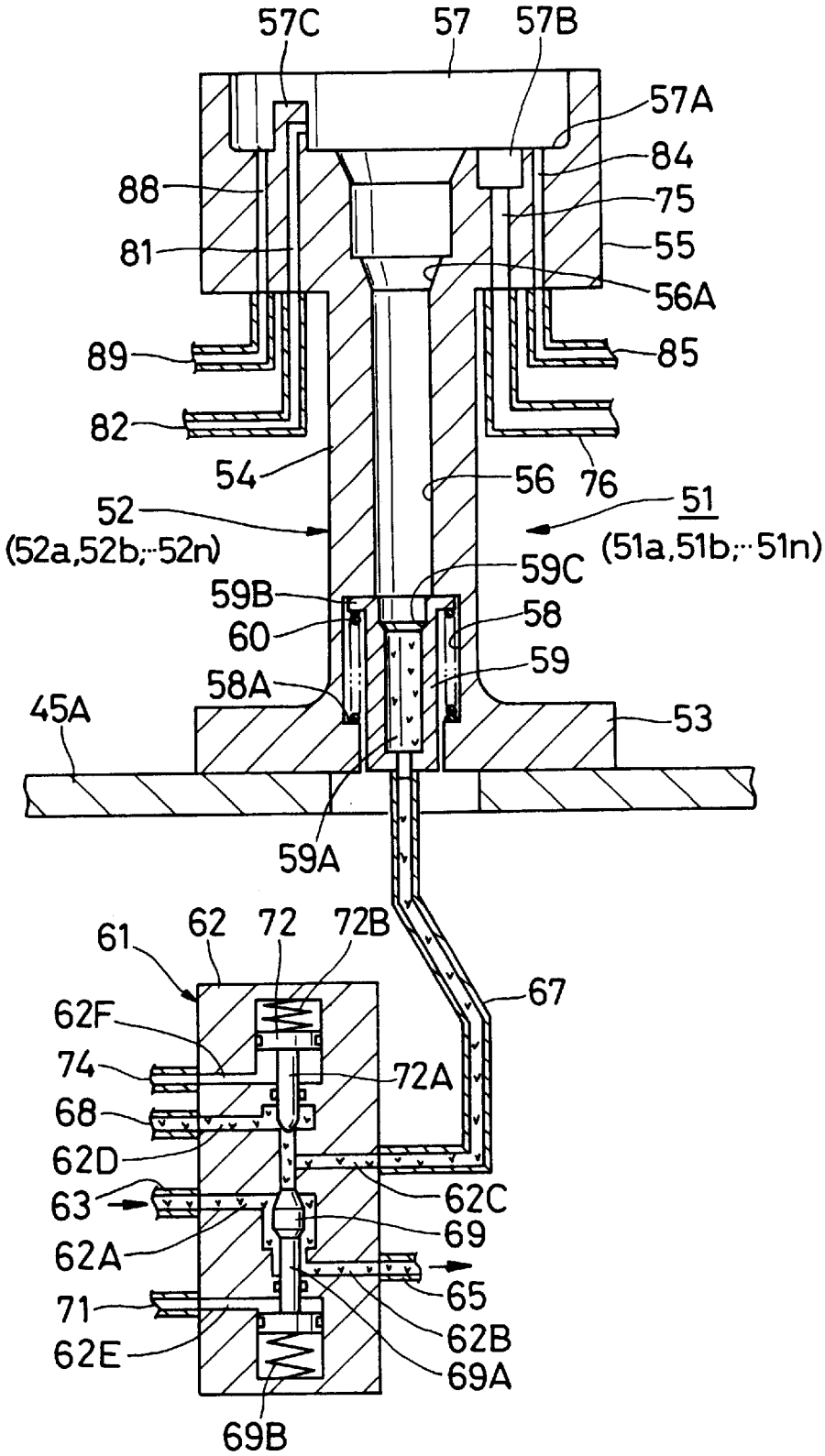
FIG. 7 is a vertical sectional view on an enlarged scale of the paint replenisher shown in FIG. 6.

The feed tube passage hole 56 on the side of the replenishing stool is formed internally of and vertically through the column portion 54 of the replenishing stool 52 to receive therein the feed tube 28 of the paint cartridge 25. As shown in FIG. 7, provided at the upper end of the feed tube passage hole 56 on the part of the replenishing stool is an inwardly converging conical portion 56A which serves to hold the container in position on the replenishing stool. That is, by fitting engagement with the conical projection 27 at the fore end of the container 26, the converging conical portion 56A hold the container 26 in a predetermined position in axial and radial directions.

Figure 8:
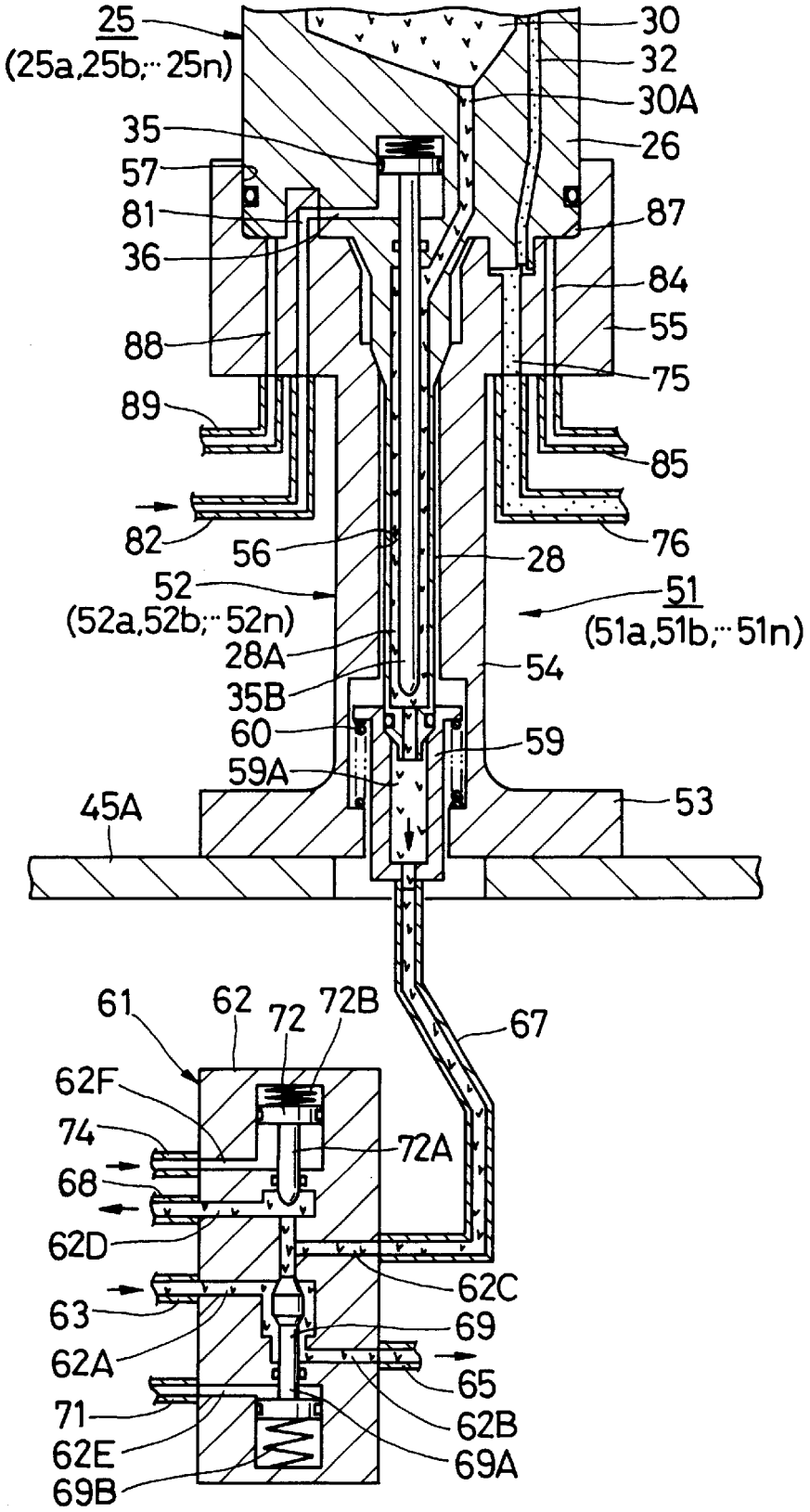
FIG. 8 is a vertical sectional view of the paint replenisher in a residual pressure extracting stage.
Figure 9:
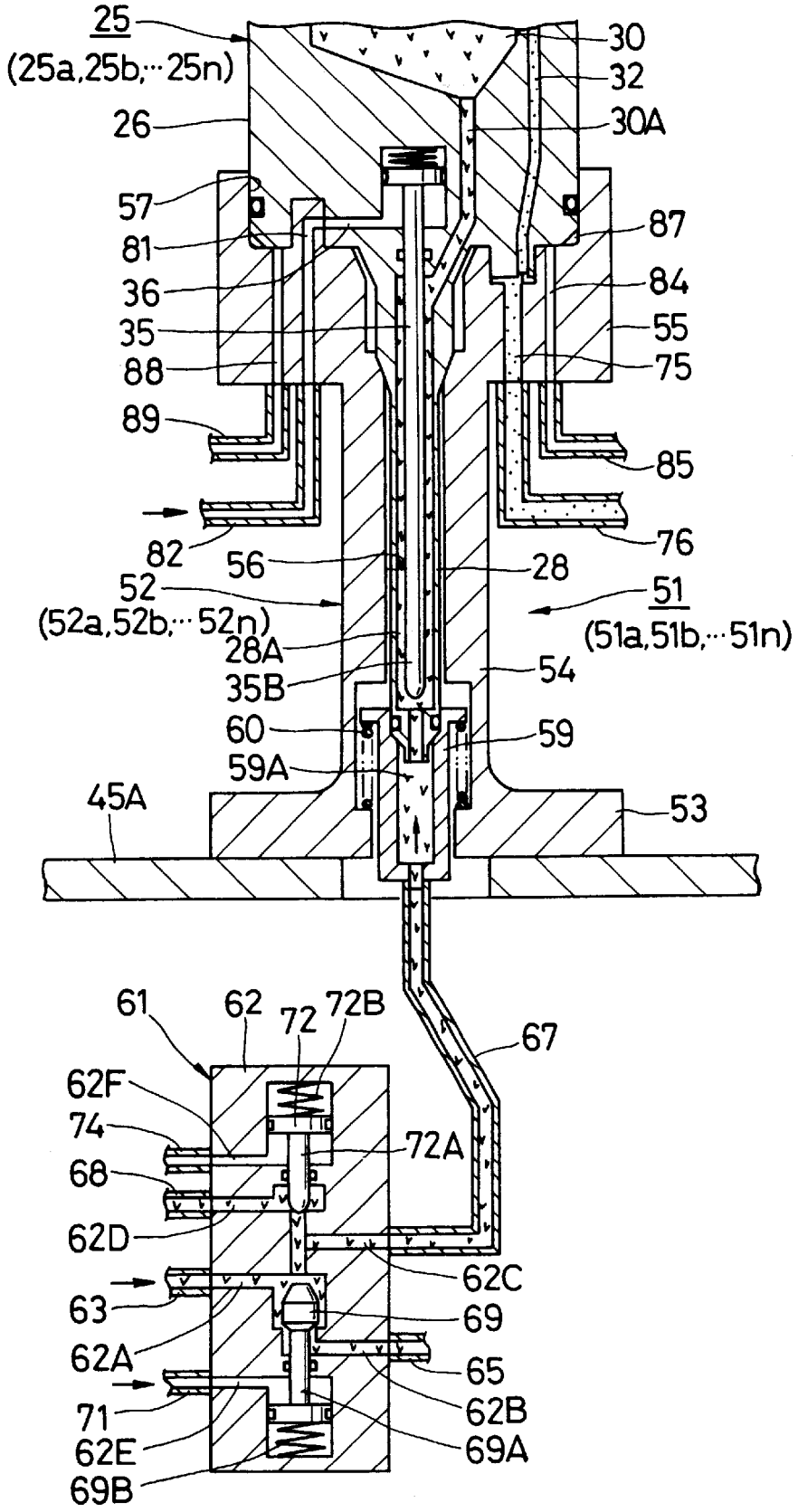
FIG. 9 is a vertical sectional view of the paint replenisher in a paint replenishing stage.

Indicated at 57 is the container support portion which is provided on one side (the upper side) of the seating block to support the container 26 of the paint cartridge 25 therein. This container support portion 57 is in the form of a recessed cylindrical cavity in communication with the upper open end of the feed tube passage hole 56 on the side of the replenishing stool. As seen in FIGS. 7 to 9, female and male connector portions 57B and 57C are separately formed at the bottom 57A of the container support portion 57 for fitting engagement with the male and female connector portions 26A and 26B on the part of the container 26, respectively. These female and male connector portions 57B and 57C serve to set the container 26 in a predetermined position in the circumferential direction when the container 26 is mounted on the container support portion 57.

Indicated at 58 is a connector receptacle bore which is formed in an axially opposite end portion of the replenishing stool 52, at a deeper position than the feed tube passage hole 56. Namely, the connector receptacle bore 58 is in the form of a cylindrical cavity which is formed by widening the diameter of a deeper portion of the feed tube passage hole 56. The lower end of the connector receptacle bore 58 is opened on the lower side of the foot portion through a stepped portion 58A of a reduced diameter.

Figure 10:
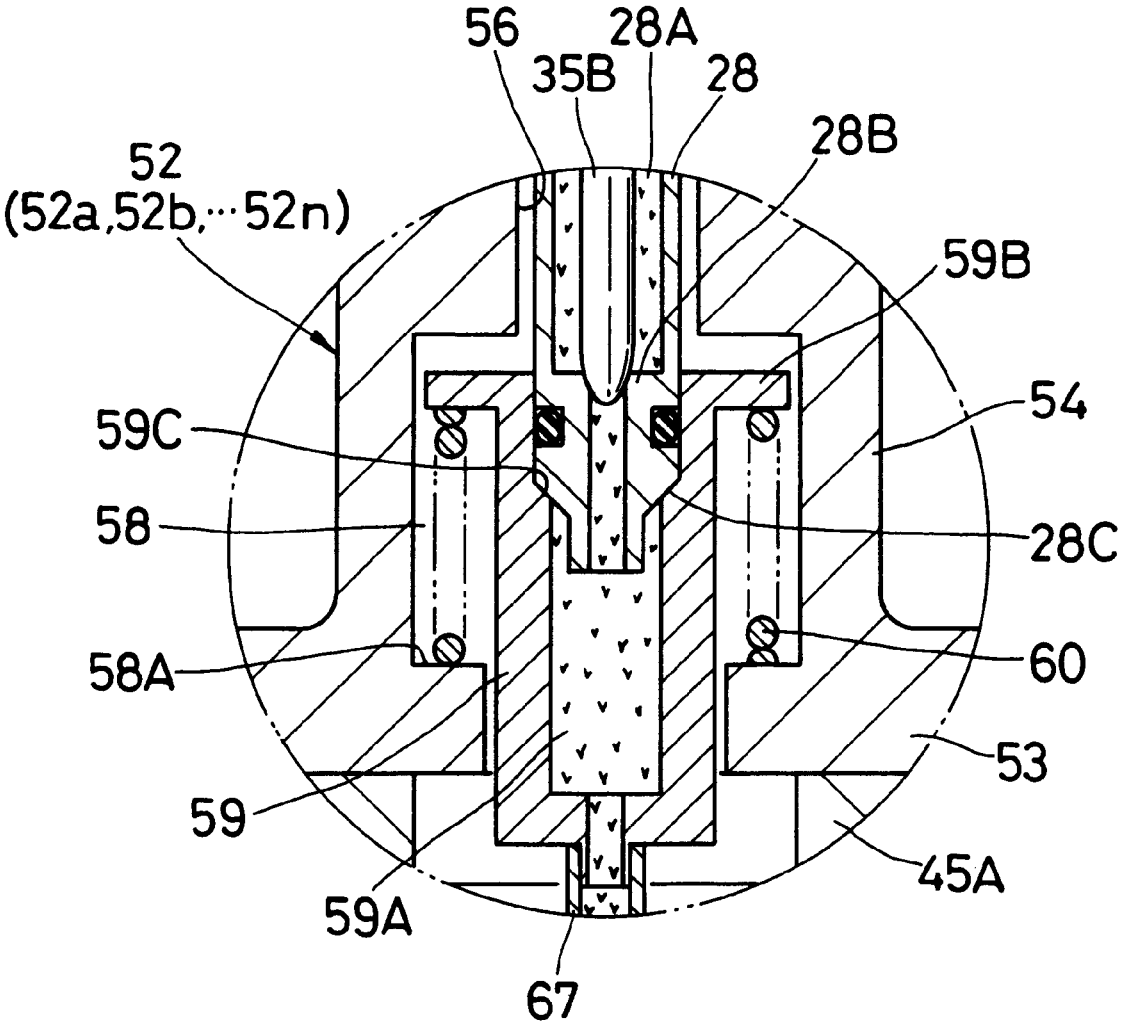
FIG. 10 is a vertical sectional view on an enlarged scale of connecting members, coil spring, feed tube shown in FIG. 6.

Denoted at 59 is a connector member which is vertically movably provided in the connector receptacle bore 58. As shown in FIG. 10, the connector member 59 is formed in a tubular shape, which internally defines a paint passage 59A and which is provided with a flange-like spring seat 59B at the upper end thereof. Further, closely to the upper end of the paint passage 59A, the connector member 59 is provided with a downwardly converging conical surface 59C which serves as a positioning member for the feed tube 28. Namely, the downwardly converging conical surface 59C is brought into fitting engagement with the conical projection 28C of the feed tube 28 to hold the distal end of the feed tube 28 at a center position of the paint passage 59A. Further, the paint passage 59A is connected to a replenishing valve 61 through a paint hose which will be described hereinafter. Since the fore distal end of the feed tube 28 is connected to the paint passage 59A, the connector member 59 functions to connect the paint passage 28A of the feed tube 28 to a paint hose 67 which forms a paint passage from the replenishing valve 61.

Indicated at 60 is a coil spring which is provided as a spring member around the outer periphery of the connector member 59. More particularly, the coil spring 60 is interposed between the spring seat 59B of the connector member 59 and a stepped portion 58A of the connector receptacle bore 58 to bias the connector member 59 in the upward direction toward the feed tube passage hole 56 on the side of the replenishing stool.

Thus, the connector member 59 is movable vertically in the upward and downward directions, and constantly urged toward the feed tube 28 by the biasing action of the coil spring 60. Therefore, even if the feed tube 28 is located in a deviated position in the upward or downward direction, the positional deviation of the feed tube 28 can be absorbed by an upward or downward movement of the connector member 59. Besides, by the action of the coil spring 60, the feed tube 28 can be securely brought into fitting engagement with the connector member 59.

Indicated at 61 is a replenishing valve which is connected to the connector member 59 to control the paint supply to the cartridge 25. The replenishing valve 61 is largely constituted by a valve casing 62, a paint passage directional control valve 69 and a residual pressure extraction valve 72 as will be described in greater detail below.

Figure 11:
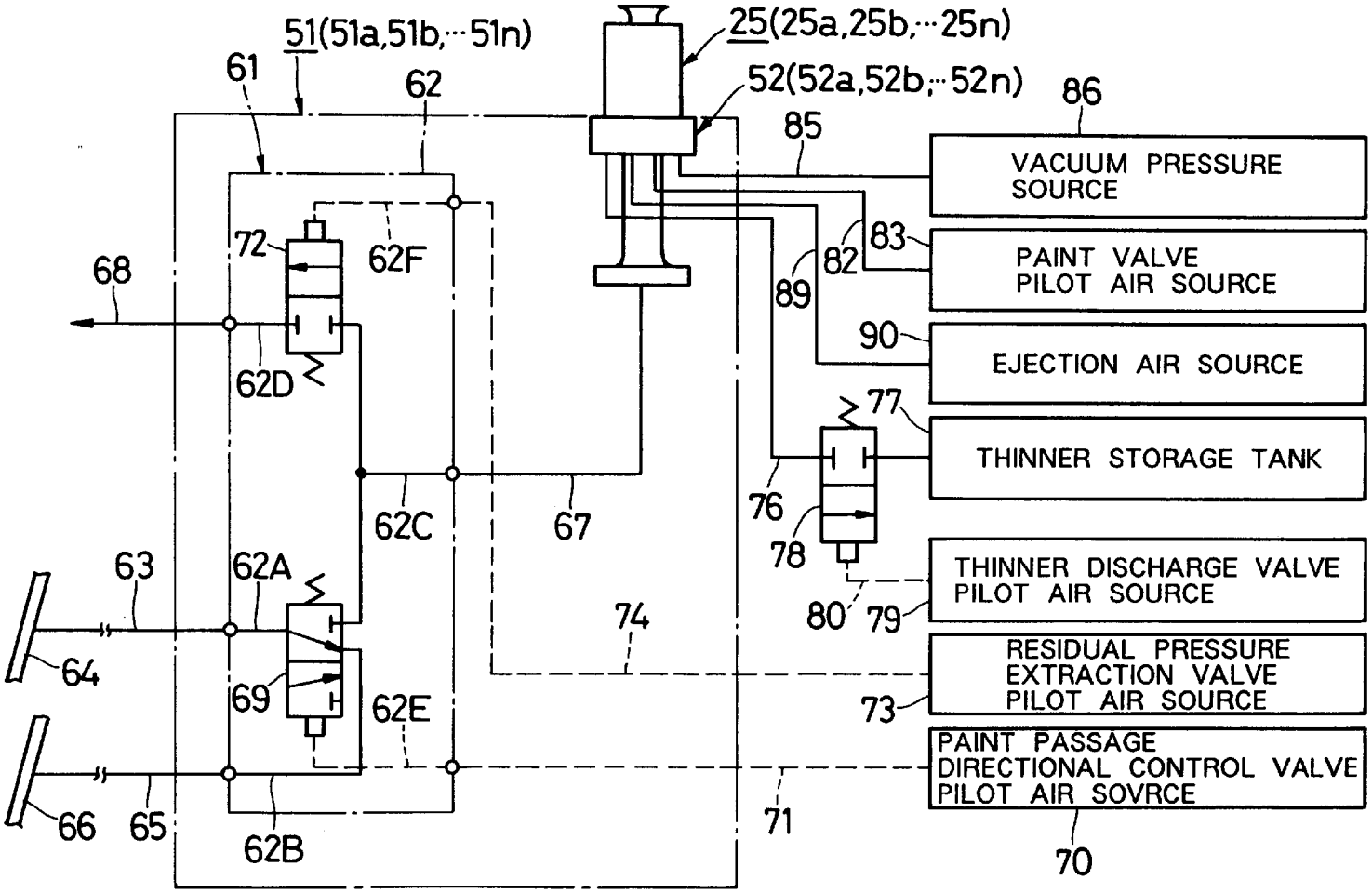
FIG. 11 is a diagram of circuit arrangements employed for the paint replenisher according to the present invention.

As shown in FIG. 11, the valve casing 62 of the replenishing valve 61 includes an influent paint passage 62A which is connected to a paint supply line 64 of a paint source through a paint conduit 63, an effluent paint passage 62B which is connected to a paint return line 66 through a paint conduit 65, a paint supply passage 62C which is connected to the paint passage 59A of the connector member 59 through a flexible paint hose 67, a drain passage 62D which is connected to the drain side through a drain conduit 68, an pilot air passage 62E which supplies pilot air to the paint passage directional control valve 69, which will be described hereinafter, and a pilot air passage 62F which supplies pilot air to the residual pressure extraction valve 72. By way of the paint passage directional control valve 69, the influent paint passage 62A can be brought into and out of communication with the effluent paint passage 62B and the paint supply passage 62C. Further, by way of the residual pressure extraction valve 69, the drain passage 62D can be brought into and out of communication with the paint supply passage 62C. In this instance, according to the invention, a paint flow passage is constituted by the paint conduit 63, influent paint passage 62A, paint supply passage 62C and paint hose 67.

Denoted at 69 is the paint passage directional control valve which is incorporated into the valve casing 62. This paint passage directional control valve 69 is largely constituted by a valve member 69A which is slidably provided within the valve casing 62 to selectively open and close the effluent paint passage 62B and the paint supply passage 62C, and a valve spring 69B adapted to bias the valve member 69A in a direction of closing the paint supply passage 62C.

More particularly, as shown in FIG. 7, the valve member 69A of the paint passage directional control valve 69 is normally positioned to block communication between the influent paint passage 62A and the paint supply passage 62C under the influence of the biasing action of the valve spring 69B, while communicating the influent paint passage 62A with the effluent paint passage 62B. As a consequence, paint is circulated through a circuit including the paint supply line 64, paint conduit 63, influent paint passage 62A, effluent paint passage 62B, paint conduit 65 and paint return line 66.

When pilot air is supplied from the paint passage directional control valve pilot air source 70 through pilot air conduit 71 and pilot air passage 62E, the valve member 69A of the paint passage directional control valve 69 is displaced against the action of the valve spring 69B to the position shown in FIG. 9, thereby blocking the communication between the influent paint passage 62A and effluent paint passage 62B while communicating the influent paint passage 62A with the paint supply passage 62C. As a result, paint from the paint supply line 64 is fed to the paint hose 67 via the paint conduit 63, influent paint passage 62A and paint supply passage 62C and permitted to flow into the connector member 59.

Indicated at 72 is the residual pressure extraction valve which is incorporated into the valve casing 61. This residual pressure extraction valve 72 is largely constituted by a valve member 72A which is slidably received in the valve casing 62 to open and close the drain passage 62D, and a valve spring 72B which is adapted to bias the valve member 72A in a closing direction. As shown particularly in FIGS. 7 and 9, normally the valve member 72A of the residual pressure extraction valve 72 is urged in a closing direction by the biasing action of the valve spring 72B to block communication between the drain passage 62D and the paint supply passage 62C. On the other hand, when pilot air is supplied from a residual pressure extraction valve pilot air source 73 through pilot air conduit 74 and pilot air passage 62F, the valve member 72A is shifted to an open position against the action of the valve spring 72B as shown in FIG. 8 to communicate the drain passage 62D with the paint supply passage 62C. As a result, pressures (residual pressures) in the paint reservoir chamber 30 of the paint cartridge 25 and in the paint supply passage 28A of the feed tube 28 are discharged to the drain side through the connector member 59, paint hose 67, paint supply passage 62C, drain passage 62D and drain conduit 68 to restore an atmospheric pressure level within the paint reservoir chamber 30 and so forth.

Indicated at 75 is a thinner discharge passage which is provided in the seating block 55 of the replenishing stool 52 as a discharge passage for an extruding liquid. This thinner discharge passage 75 is opened at one end thereof into the female connector portion 57B of the container support portion 57, and connected at the other end to a thinner reservoir tank 77 through a thinner conduit 76 as shown in FIG. 11. Through the thinner discharge passage 75, the thinner which flows out of the thinner chamber 31 of the paint cartridge 25 at the time of paint replenishment is discharged to a thinner reservoir tank 77 by way of a thinner discharge valve 78.

Denoted at 78 is the thinner discharge valve which is provided within the length of the thinner conduit 76. When replenishing the paint to the cartridge, the thinner discharge valve 78 is opened by pilot air which is supplied from a thinner discharge valve pilot air source 79 through a pilot air conduit 80, thereby holding the thinner conduit in communication to discharge thinner which flows out of the thinner chamber 31 of the paint cartridge 25 during a replenishing operation. On the other hand, upon completion of a replenishing operation, the thinner discharge valve 78 closes the thinner conduit 76 to prevent thinner from flowing out of the thinner passage 32 on the side of the paint cartridge.

Indicated at 81 is a pilot air passage which is provided on the side of the replenishing stool, more particularly, formed in the seating block 55 of the replenishing stool. One end of the pilot air passage 81 is connected to a paint valve pilot air source 83 through a pilot air conduit 82. The other end of the pilot air passage 81 is opened in a circumferential surface of the male connector portion 57C of the container support portion 57 in a confronting position relative to the pilot air passage 36 on the side of the paint cartridge. Consequently, when the paint cartridge 25 is mounted on the container support portion 57 of the replenishing stool 52, the pilot air passage 81 on the side of the replenishing stool is communicated with the pilot air passage 36 on the side of the paint cartridge to supply pilot air from the paint valve pilot air source 83 to the paint valve 35.

Indicated at 84 is an air suction passage which is provided in the seating block portion 55 and opened in a bottom portion 57A of the container support portion 57. This air suction passage 84 is connected to a vacuum source 86 through a vacuum conduit 85. Through the air suction passage 84, air is sucked out of a vacuum space 87 which is defined between a deep bottom portion of the container support portion 57 and the container 26 of the paint cartridge 25 so that the paint cartridge 25 is fixedly gripped in the container support portion 57 by suction force.

Designated at 88 is an ejection air supply passage which is also provided in the seating block portion 55 and opened in a bottom portion 57A of the container support portion 57. This ejection air supply passage 88 is connected to an ejection air source 90 through an air conduit 89. At the time of dismantling the paint cartridge 25 from the container support portion 57, air is supplied from the ejection air passage 88 to the vacuum space 87 thereby to release the paint cartridge 25 from the suction grip.

Figure 12:
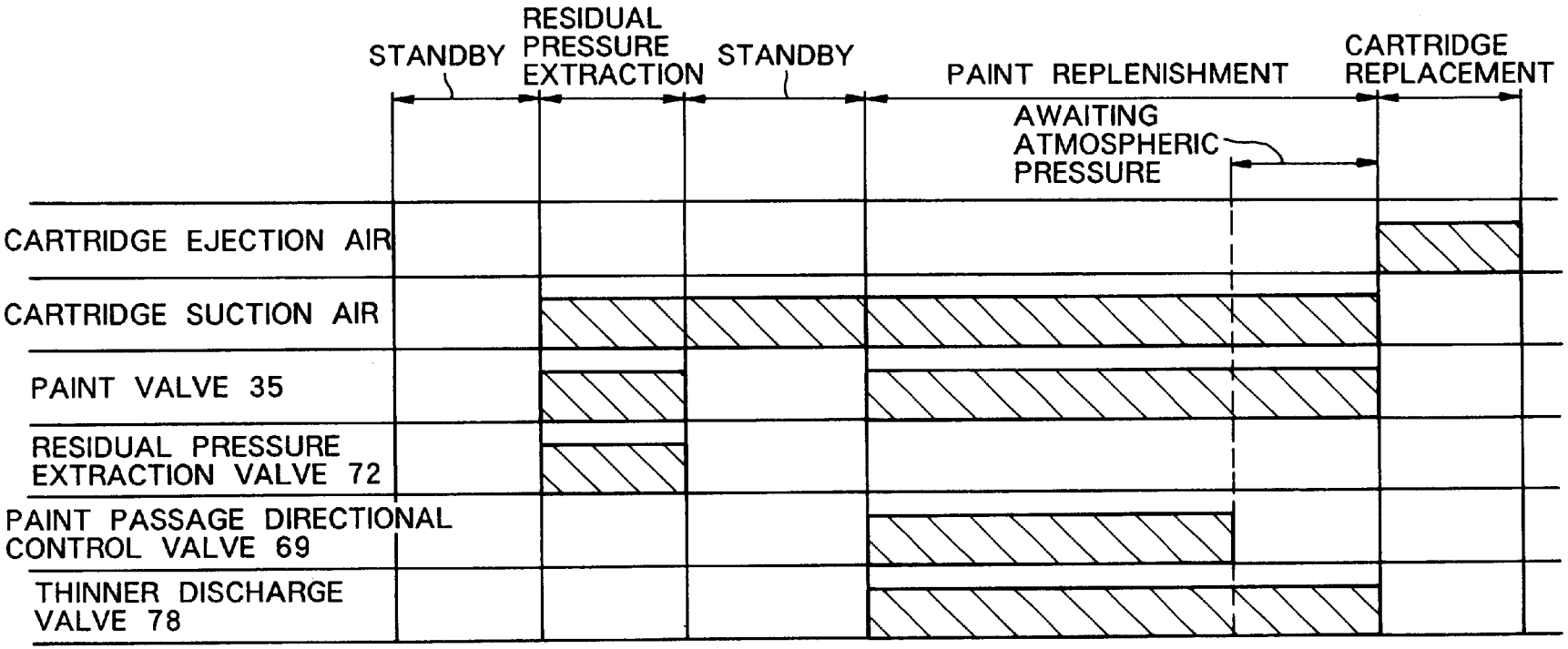
FIG. 12 is an operational time chart of the paint cartridge replenisher according to the present invention.

Being arranged as described above, the paint cartridge replenisher 51 of the present embodiment operates in the manner as explained below with reference to the operational time chart of FIG. 12.

In the first place, upon finishing a coating operation, a paint cartridge 25 in the cartridge mount portion 16 of the housing 12 is removed therefrom by a cartridge handler, and said paint cartridge 25 is mounted, for example, on a replenishing stool 52*a* of a paint replenisher unit 51*a* of color a.

More specifically, at the time of mounting the paint cartridge 25 on the replenishing stool 52, the container 26 is fitted into the container support portion 57 while the feed tube 28 is placed in the feed tube passage hole 56 on the side of the replenishing stool.

Further, as soon as the paint cartridge 25 is set on the container support portion 57, air in the vacuum space 87 is sucked out through the air suction passage 84 to hold the paint cartridge 25 fixedly on the replenishing stool 52 with suction force.

Furthermore, upon setting the container 26 of the paint cartridge 25 on the container support portion 57 of the replenishing stool 52, the male and female connector portions 26A and 26B of the container 26 are brought into fitting engagement with the female and male connector portions 57B and 57C on the part of the container support portion 57, respectively, to set the container 26 automatically in a predetermined position relative to the container support portion 57 in the circumferential direction. In addition, at this time, the conical projection 27 on the container 26 is brought into fitting engagement with the converging conical portion 56A of the feed tube passage hole 56 on the side of the replenishing stool to set the container 26 in position relative to the container support portion 57 in both axial and radial directions.

Further, as soon as the feed tube 28 is fully passed into the feed tube passage hole 56 on the part of the replenishing stool, the fore distal end of the feed tube 28 is fitted into the paint passage 59A in the connector member 59. At this time, the conically projecting surface 28C at the fore distal end of the feed tube 28 is brought into fitting engagement with the conical recess 59C on the connector member 59. Accordingly, the opening at the fore distal end of the feed tube 28 is automatically located in a center position within the paint passage 59A of the connector member 59.

Besides, at the time of fitting the fore distal end of the feed tube 28 into the connector member 59, the connector member 59 can move either in the upward or downward direction depending upon the vertical position of the feed tube 28, thereby absorbing a vertical positional deviation of the feed tube 28 if any. In addition, since the connector member 59 is urged toward the feed tube 28 by the biasing action of the coil spring 60, the feed tube 28 and the connector member 59 can be fitted with each other in a liquid-tight state.

In this manner, when the paint cartridge 25 is set on the container support portion 57 of the replenishing stool 52 in a standby state (the state of FIG. 6) or when the paint cartridge 25 is in a dismantled state (the state of FIG. 7), the influent paint passage 62A is communicated with the effluent paint passage 62B by the paint passage directional control valve 69. Accordingly, the paint which is supplied to the replenishing valve 61 from a paint supply line 64 through the paint conduit 63 is returned to the paint return line 66 through the paint conduit 65 and recirculated. This recirculation contributes to prevent separation and sedimentation of pigment components of the paint which might occur while in the standby state.

Next comes an operation for extraction of residual pressures in the paint reservoir chamber 30 of the paint cartridge 25 and in the paint supply passage 28A of the feed tube 28. In this residual pressure extracting stage, as shown in FIG. 8, pilot air is supplied to the paint valve 35 from the paint valve pilot air source 83 via the pilot air conduit 82, pilot air passage 81 on the side of the replenishing stool and pilot air passage 36 on the side of the paint cartridge to open the paint valve 35, thereby communicating the paint supply passage 28A of the feed tube 28 with the paint passage 59A of the connector member 59. At the same time, pilot air is supplied to the residual pressure extraction valve 72 from the residual pressure extraction valve pilot air source 73 via the pilot air conduit 74 and pilot air passage 62F to open the residual pressure extraction valve 72, thereby communicating the paint supply passage 62C with the drain passage 62D.

As a consequence, the paint reservoir chamber 30 of the cartridge 25 and the paint supply passage 28A of the feed tube 28 are communicated with the drain side through the paint passage 59A, paint hose 67, paint supply passage 62C, drain passage 62D and drain conduit 68. Therefore, residual pressures which remain in the paint reservoir chamber 30 are discharged to the drain side, so that an atmospheric pressure level is restored in the paint reservoir chamber 30 and the paint supply passage 28A.

Upon completing the residual pressure extraction, a paint replenishing operation may follow. However, in a case where a coating operation is carried out according to programed operational steps, a paint replenishing operation is set and started at a time point which is caluculated backward and close enough to a coating start time for preventing separation and sedimentation of pigment components in replenished paint within the cartridge 25.

In a paint replenishing stage, as shown in FIG. 9, the residual pressure extraction valve 72 is closed, and at the same time pilot air is supplied to the replenishing valve 61 from a paint passage directional control valve pilot air source 70 via pilot air conduit 71 and pilot air passage 62E, switching the paint passage directional control valve 69 to communicate the influent paint passage 62A with the paint supply passage 62C. As a result, the paint which is supplied to the replenishing valve 61 from the paint supply line 64 through the paint conduit 63 is allowed to flow into the connector member 59 via influent paint passage 62A, paint supply passage 62C and paint hose 67. The supplied paint is further fed forward, from the paint passage 59A of the connector member 59 to the paint supply passage 28A of the feed tube 28 and to the intercommunicating passage 30A, to replenish the paint reservoir chamber 30 of the cartridge.

In this paint replenishing operation, thinner in the thinner chamber 31 of the paint cartridge 25 is forced to flow out of the thinner chamber 31 in proportion to the amount of paint which is replenished into the paint reservoir chamber 30. Therefore, pilot air is supplied to the thinner discharge valve 78 from a thinner discharge valve pilot air source 79 through a pilot air conduit 80, thereby opening the thinner discharge valve 78 to hold the thinner discharge passage 75 in communication. Accordingly, the thinner which flows out of the thinner chamber 31 is discharged to the thinner storage tank 77 through the thinner passage 32 on the side of the cartridge, the thinner discharge passage 75 and the thinner conduit 76.

As soon as a specified amount of paint is replenished into the paint reservoir chamber 30 of the cartridge 25, the paint valve 35 on the cartridge 25 is closed, and then the influent paint passage 62A is switched to the side of the effluent paint passage 62B by way of the paint passage directional control valve 69 of the replenishing valve 61, and the thinner discharge valve 78 is closed. At this time, the influent paint passage 62A is switched to the effluent paint passage 62B in the first place by means of the paint passage directional control valve 69 of the replenishing valve 61. Then, upon lapse of a predetermined time period, namely, as soon as the paint hose 67 settles down from an inflated state and an atomospheric pressure level is restored in the paint hose 67, paint supply passage 28A of the feed tube 28, paint reservoir chamber 30, thinner chamber 31 and thinner passage 32 on the side of the paint cartridge, the paint valve 35 and the thinner discharge valve 78 are closed. Accordingly, leaks of paint and thinner from the cartridge 25 are prevented at the time when the cartridge 25 is removed from the replenishing stool 52.

In a next stage, the refilled paint cartridge 25 is removed from the replenishing stool 52 and set in the housing 12 of the coating apparatus 11 in the manner as described below. In this stage, firstly ejection air is supplied to the vacuum space 87 from the ejection air source 90 through the air conduit 89 and ejection air supply passage 88 to cancel the suction grip and free the paint cartridge 25 from the container support portion 57 of the replenishing stool 52. Then, the paint cartridge 25 is pulled upward and extracted from the replenishing stool 52, and loaded into the coating apparatus 11 on the coating robot 1 in preparation for a coating operation in a next color.

In this manner, according to the present embodiment, the paint cartridge replenisher 51 is constituted by a replenishing stool 52 which is provided with a container support portion 57 on the upper side thereof, a feed tube passage hole 56 which is formed axially through the replenishing stool 52, and the connector member 59 which is provided in the replenishing stool 52 in a deeper position than the feed tube passage 56 and adapted to be brought into fitting engagement with a distal fore end portion of the feed tube 28 in a liquid-tight state.

In mounting the paint cartridge 25 within the container support portion 57 of the replenishing stool 52, the feed tube 28 is passed into the feed tube passage hole 56 on the side of the replenishing stool until the fore distal end of the feed tube 28 is brought into fitting engagement with the connector member 59, thereby permitting to utilize the opening at the fore distal end of the feed tube 28 as a replenishing port in refilling paint into the container 26 of the cartridge 25.

Therefore, there is no need for providing a paint replenishing port on each paint cartridge separately from or in addition to the feed tube as in the prior art mentioned hereinbefore, and it becomes possible to simplify the construction of the paint cartridge and to enhance the efficiency of assembling work to realize a significant cut in production cost. In addition, the abolishment of a separate supply port on the paint cartridge can reduce the possibilities of paint leaks and accordingly can improve the reliability of paint cartridges in this regard. Further, it becomes possible to shorten the connection time for the paint replenishment.

Moreover, the replenishing stool 52 is provided with the connector member 59 which is vertically movable up and down and biased upward by a coil spring 60 to get into fitting engagement with the fore distal end of the feed tube 28. Accordingly, when the fore distal end of the feed tube 28 is fitted into the connector member 59, the connector member 59 can be moved in the upward or downward direction to absorb a vertical positional deviation of the feed tube 28 if any. Besides, by the action of the coil spring 60, the connector member 59 is held in fitting engagement with the feed tube 28 in a liquid-tight state to prevent paint leaks which might otherwise occur during a paint replenishing operation.

Further, in the preparatory standby stage prior to paint replenishment, the influent paint passage 62A is held in communication with the effluent paint passage 62B by the paint passage directional control valve 69, letting paint recirculate through a circuit including the paint supply line 64, paint conduit 63, influent paint passage 62A, effluent paint passage 62B, paint conduit 65 and paint return line 66. This recirculation of paint prevents separation or sedimentation of pigments or other components of the paint in the standby stage. On the other hand, at the time of replenishing paint into the cartridge 25, the paint passage directional control valve 69 is switched to communicate the influent paint passage 62A with the paint supply passage 62C, thereby permitting the paint from the paint supply line 64 to be replenished into the container 26 through the influent paint passage 62A, paint supply passage 62C, connector member 59 and feed tube 28.

Further, the connector member 59 is provided with the drain conduit 68 in communication with the drain side, and the residual pressure extraction valve 72 is provided within the length of the drain conduit 68. Therefore, upon opening the residual pressure extraction valve 72, residual pressures in the feed tube 28 and the container 26 of the paint cartridge 25 are released to restore atmospheric pressure therein. This means that, paint can be smoothly and quickly replenished into the paint reservoir chamber 30 free of reverse flows which would otherwise occur in the paint supply passage 62C due to a back pressure. In addition, air bubbles which may exist in the paint hose 67 and the paint supply passage 62C can be removed at the time of the residual pressure extraction, precluding the possibilities of air bubbles being trapped in the paint to be replenished into the paint reservoir chamber 30.

Further, the connector member 59 is provided with the conically converging recess 59C for engagement with the conical projection 28C which is provided at the fore distal end of the feed tube 28. Therefore, by the conically converging recess 59C, the opening at the distal end of the feed tube 28 can be located at the center of the paint passage 59A in the connector member 59 and held in fitting engagement with the connector member 59 in a liquid-tight state.

Further, the container support portion 57 of the replenishing stool 52 is provided with the female and male connector portions 57B and 57C for engagement with the male and female connector portions 26A and 26B, so that the container 26 can be automatically set in position on the container support portion 57 in the circumferential direction.

Further, the replenishing stool 52 is provided with the conically converging portion 56A for engagement with the conical projection which is provided on the front side of the paint cartridge 25, so that the container 26 can be automatically located in position on the container support portion 57 in axial and radial directions.

Further, the replenishing stool 52 is provided with the air suction passage 84 in the bottom portion 57A of the container support portion 57, so that, upon sucking air out of the vacuum space 87 between the container support portion 57 and the container 26, the paint cartridge 25 is fixedly gripped in position on the replenishing stool 52 by suction force and prevented from coming off the replenishing stool 52. In addition, upon supplying ejection air to the vacuum space 87 through the ejection air supply passage 88, the paint cartridge 25 can be released from the suction grip and dismantled from the replenishing stool 52.

Further, the replenishing stool 52 is provided with the pilot air passage 81 thereby to actuate the paint valve 35. Therefore, at the time of paint replenishment, the paint valve 35 in the paint cartridge 25 is opened by feeding pilot air thereto through the pilot air passage 81, thereby feeding paint forward through the paint supply passage 28A of the feed tube 28 to replenish the paint cartridge 25. As soon as a paint replenishing operation is completed, the paint valve 35 is closed by shutting off the supply of pilot air, preventing paint leaks from the feed tube 28.

On the other hand, the replenishing stool 52 is provided with the thinner discharge passage 75 in communication with the thinner passage 32 on the side of the paint cartridge 25 to discharge therethrough the thinner which is forced to flow out of the thinner chamber 31 during the paint replenishment. Accordingly, while replenishing paint into the paint reservoir chamber 30 of the cartridge 25, the effluent thinner from the thinner chamber 31 can be discharged through the thinner discharge passage 75.

In the foregoing embodiment, the rotary atomizing head type coating apparatus 11 is described as being mounted on the horizontal arm 4 of the coating robot 1. However, the present invention is not limited to coating apparatus of this sort, and can be applied similarly for a coating apparatus which is mounted on a reciprocator or other working mechanism.

Further, in the foregoing embodiment, the piston 29 is employed as a movable partition wall. However, there may be employed a movable partition wall other than the piston 29, for example, there may be employed a flexible bag such as tubular bellows or the like having the inner side thereof in communicated with the feed tube.

Further, in the foregoing embodiment, thinner is used as an extruding liquid. However, depending upon the paint type or upon the method of high voltage application, water or other extruding liquid may be used in place of thinner.

Furthermore, in the foregoing embodiment, two or more paint cartridges 25 may be provided for each color, in anticipation of coating operations where same paint color or colors are used continuously.

INDUSTRIAL APPLICABILITY

As clear from the foregoing detailed description, according to the present invention, a pant cartridge replenisher is constituted by: a replenishing stool having a feed tube passage hole extended axially therethrough to receive a feed tube of a paint cartridge, and a container support portion provided on an open top side of said replenishing stool and adapted to support a container of said paint cartridge therein; a connector member provided in a deeper position within said replenishing stool than said feed tube passage hole to connect a fore distal end portion of said feed tube to a paint passage leading to a paint source; and a replenishing valve provided within a length of said paint passage to turn on and off paint supply to said paint cartridge through said connector member. Upon completing a coating operation, a paint cartridge on a coating apparatus is removed therefrom and set on the container support portion of the replenishing stool, thereby passing the feed tube of the paint cartridge into the feed tube passage hole and fitting a fore distal end of the feed tube into the connector member. In this state, the replenishing valve is opened to supply paint to the connector member from a paint source and replenish the paint into the paint cartridge through the feed tube, thereby utilizing as a replenishing port the opening at the fore distal end of the feed tube which is fitted in the connector member.

As a consequence, it becomes unnecessary to provide a paint filling port separately from the feed tube as in the prior art mentioned hereinbefore. Namely, it becomes possible to simplify the construction of paint cartridges and to enhance the efficiency of assembling work to realize a significant reduction in production cost. In addition, the abolishment of a paint replenishing port leads to lessen the possibilities of paint leaks from liable portions and to enhance the reliability for leak-free performances.

What is claimed is:

1. A paint replenisher for paint cartridges having a feed tube extended axially forward from one end of a container for supplying and replenishing paint therethrough, characterized in that said paint replenisher comprises:

a replenishing stool having a feed tube passage hole formed axially therethrough to receive said feed tube of said paint cartridge, and provided with a container support portion adapted to support said container of said paint cartridge over an upper open end of said feed tube passage hole;

a connector member provided within said replenishing stool in a deeper position than said feed tube passage hole and adapted to connect a fore distal end portion of said feed tube to a paint passage leading to a paint source; and a replenishing valve provided in said paint passage and adapted to turn on and off paint supply to said paint cartridge through said connector member;

said replenishing valve being constituted by an influent paint passage connected to said paint source, an effluent paint passage for returning paint to said paint source, a paint supply passage for connecting said influent paint passage to said connector member, and a directional control valve operative to connect said influent paint passage either to said effluent paint passage or to said paint supply passage.

2. A paint replenisher for paint cartridges as defined in claim 1, wherein said connector member is axially movably provided within said replenishing stool, and associated with a biasing spring member and thereby constantly urged toward said feed tube.

3. A paint replenisher for paint cartridges as defined in claim 1, further comprising a drain passage to connect said paint supply passage to a drain side, and a residual pressure extraction valve provided within a length of said drain passage.

4. A paint replenisher for paint cartridges as defined in claim 1, wherein said connector member is provided with a feed tube positioning portion adapted to hold a fore distal end portion of said feed tube in a predetermined position by engagement therewith.

5. A paint replenisher for paint cartridges as defined in claim 1, wherein said container support portion of said replenishing stool is provided with a container positioning portion adapted to hold said container in position on said container supporting portion by engagement with a front end portion of said container.

6. A paint replenisher for paint cartridges as defined in claim 1, wherein said replenishing stool further comprises a vacuum space to be formed in said container support portion on the inner side of said container when the container is set in position on the container support portion, and an air suction passage opened into said vacuum space and operative to suck out air from said vacuum space to grip said container fixedly in said container support portion by suction force.

7. A paint replenisher for paint cartridges as defined in claim 1, wherein said replenishing stool further comprises a pilot air passage adapted to supply pilot air to a paint valve provided on the side of said paint cartridge.

8. A paint replenisher for paint cartridges as defined in claim 1, wherein said replenishing stool further comprises an extruding liquid discharging passage for a paint extruding liquid which is discharged from said container during a paint replenishing operation on said paint cartridge.

* * * * *